US007528690B2

(12) United States Patent
Christmann et al.

(10) Patent No.: US 7,528,690 B2
(45) Date of Patent: May 5, 2009

(54) ELECTRICAL SWITCHING DEVICE

(75) Inventors: Jürgen Christmann, Bammental (DE); Ralf Weber, Heidelberg (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/513,132

(22) Filed: Aug. 31, 2006

(65) Prior Publication Data

US 2007/0046403 A1 Mar. 1, 2007

(30) Foreign Application Priority Data

Aug. 31, 2005 (DE) ..... 10 2005 041 231

(51) Int. Cl.
*H01H 75/12* (2006.01)
*H01H 77/00* (2006.01)
*H01H 81/00* (2006.01)
*H01H 83/00* (2006.01)

(52) U.S. Cl. ..... 335/35; 335/2; 335/6; 335/21

(58) Field of Classification Search ..... 335/35
See application file for complete search history.

(56) References Cited

U.S. PATENT DOCUMENTS 2,783,330 A * 2/1957 Casey ..... 337/55
2,941,058 A * 6/1960 Norden ..... 337/59
3,790,911 A * 2/1974 Kick et al. ..... 335/201
3,950,714 A * 4/1976 Mrenna et al. ..... 335/35
3,983,454 A * 9/1976 Cotton et al. ..... 361/37
4,001,743 A * 1/1977 Arnhold ..... 335/201
4,079,345 A * 3/1978 Pietsch ..... 335/10
4,132,967 A * 1/1979 Gryctko ..... 335/11
4,156,219 A * 5/1979 Coleman ..... 335/175
4,614,928 A * 9/1986 Westermeyer ..... 335/201
4,636,760 A * 1/1987 Lee ..... 335/14
4,714,907 A * 12/1987 Bartolo et al. ..... 335/45
4,725,799 A * 2/1988 Bratkowski et al. ..... 335/14
5,151,674 A * 9/1992 Flohr ..... 335/16
5,185,590 A * 2/1993 DiVincenzo ..... 335/201
7,009,129 B2 * 3/2006 Vierling ..... 200/400

FOREIGN PATENT DOCUMENTS

DE 10335704 A * 3/2005
EP 710973 A1 * 5/1996

* cited by examiner

*Primary Examiner*—Elvin G Enad
*Assistant Examiner*—Mohamad A Musleh
(74) *Attorney, Agent, or Firm*—Buchanan Ingersoll & Rooney PC

(57) ABSTRACT

The invention relates to an electrical switching device, having a thermal release, an electromagnetic release, and a switching mechanism with a latching point. A contact base for moving a contact member is located between the thermal release and the electromagnetic release. The thermal release is coupled to a release lever by means of a connecting rod passing over the contact base so that both the thermal release and the electromagnetic release open the latching point in the event of an overcurrent and/or short-circuit current.

4 Claims, 2 Drawing Sheets tripped

ELECTRICAL SWITCHING DEVICE

CROSS REFERENCE TO RELATED APPLICATIONS

This application claims priority under 35 U.S.C. §119 to German Application 10 2005 041 231.9 filed in Germany on 31 Aug. 2005 the entire contents of which is hereby incorporated by reference in its entirety.

BACKGROUND

An electrical switching device is disclosed.

In particular, a miniature circuit breaker is disclosed which can be used for disconnecting loads in the event of a short-circuit or overcurrent. Naturally, the breaker can also be used in combination with motor circuit breakers and with residual current devices.

A miniature circuit breaker has in its interior an electromagnetic release with a plunger-type electromagnet, with a core and a moving armature around which a coil is wound. In the case of a short circuit, the armature moves and, on the one hand, strikes the contact lever so that the contact point is rapidly opened; on the other hand, it also provides long-term opening of the contact point via a latch. The thermal release which is in the form of a bimetallic release in most cases acts exclusively on the latch to effect the long-term opening of the contact point. The bimetallic strip is in most cases a strip which bends due to the different coefficients of expansion of the metals joined to one another. Naturally, a strip of a shape memory alloy can also be used instead of a thermal bimetallic strip.

In the switch S2 from the company ABB Stotz Kontakt GmbH, Heidelberg, the latch is supported between two boards which are connected to one another and also have or accommodate the bearing points for the corresponding components forming the latching point. In this switch, the electromagnetic release is located between the thermal bimetallic strip and the contact lever, i.e. the contact lever is located on one side and the thermal bimetallic strip on the other.

SUMMARY

A switch is disclosed which can considerably simplify the assembly process.

A contact base for the moving contact member can be located between the thermal and the electromagnetic release, in that, together with a release lever supported rotatably and interacting with the electromagnetic release and the thermal release, the latching lever forms the latching point and in that the thermal release is coupled to the release lever by means of a connecting rod passing over the contact base so that both the thermal release and the electromagnetic release open the latching point in the event of an overcurrent and/or short-circuit current and in that a striking lever is provided, which is mounted such that it can rotate, can be pivoted on the one hand by the thermal release and on the other hand by the electrical release and, on being released, pivots the release lever in the direction to unlatch the latching point.

According to one particularly advantageous refinement, the striking lever is a double-armed lever whose rotation axis is arranged between the latching point and the electrical release, with its first arm interacting with the latching lever and its second arm interacting with the thermal and magnetic release.

According to one further embodiment, the second arm can cover the armature of the electromagnetic release.

The rotation axis of the striking lever can be advantageously located in a fixed position on a line which is formed by the bearing points of the release or striking lever and the switching handle, with this line running essentially at right angles to the mounting plane and to the front wall.

An exemplary refinement can considerably improve the matching between the unlatching before striking the contact lever, since the tolerance chain has been considerably shortened in comparison to that of the previous tilting mechanism in the S2 switch from the company ABB Stotz-Kontakt GmbH, Heidelberg. The matching in this case takes place in a part in the release lever. The striking pin in this case strikes the release lever which is moved until unlatching occurs, and is only then moved to the moving contact mount, in order to open it.

BRIEF DESCRIPTION OF THE DRAWINGS

The invention as well as further advantageous refinements and improvements and further advantages will be explained and described in more detail with reference to the drawing, which illustrates one exemplary embodiment of the invention, and in which.

DETAILED DESCRIPTION

Figure 2:
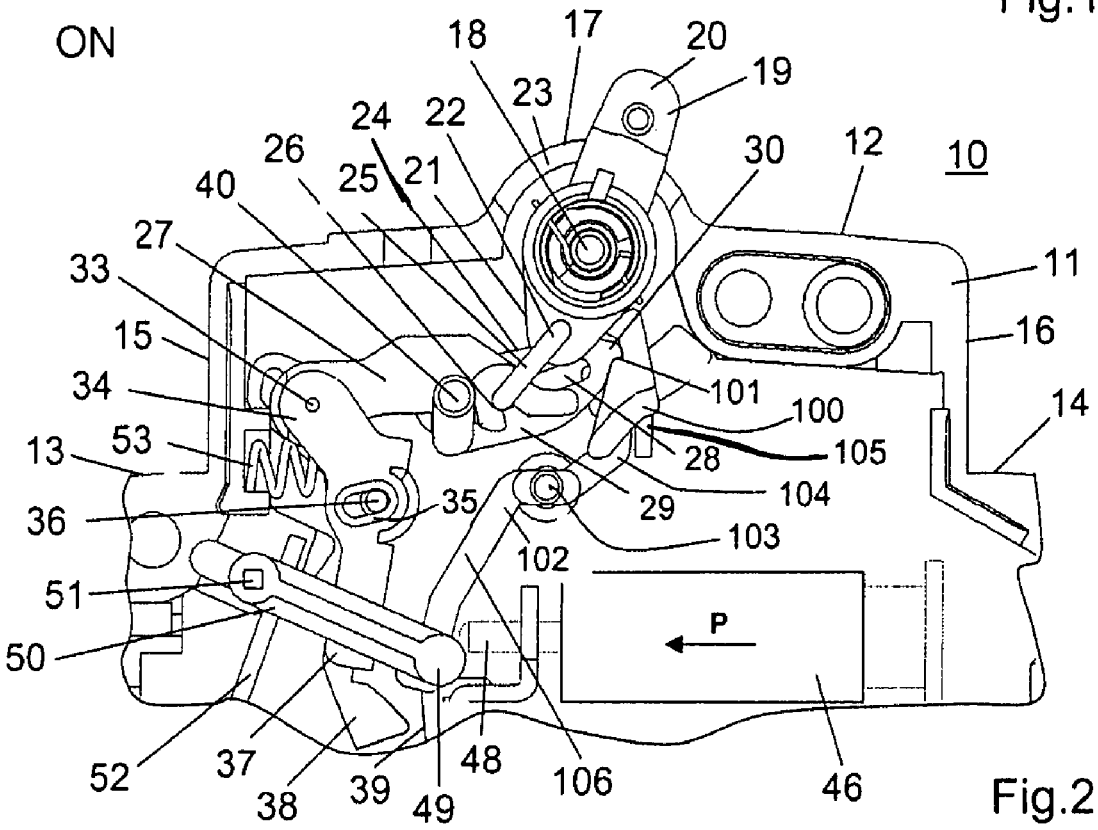
FIG. 2 shows a partial view corresponding to FIG. 1, in the on position.

Reference will be made to FIG. 2.

Figure 1:
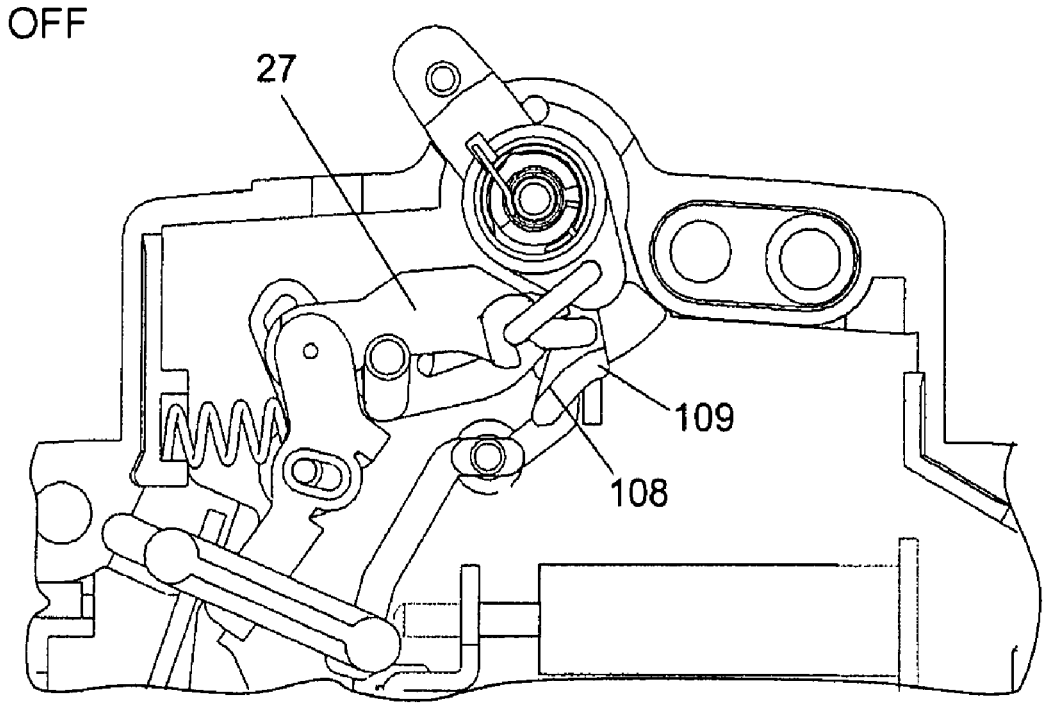
FIG. 1 shows a partial view into an exemplary switching device in the off position.
Figure 3:
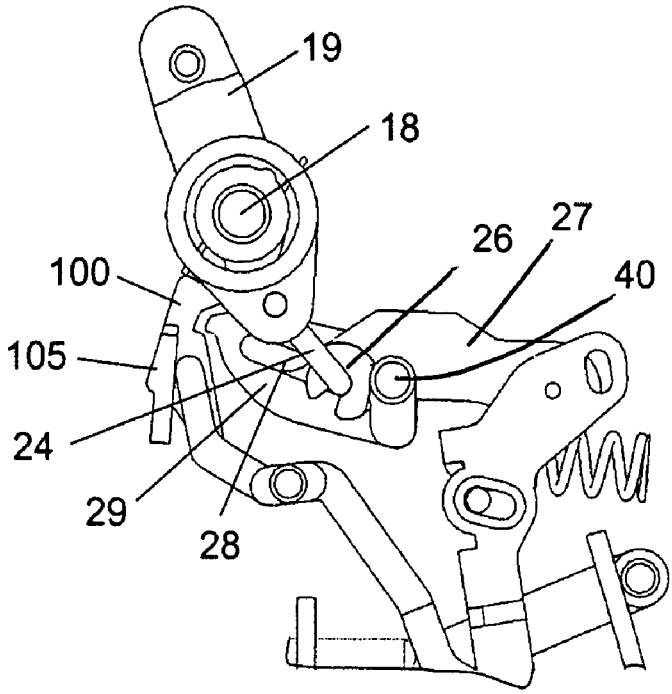
FIGS. 3 and 4 each show a view which corresponds to the views of the switching device shown in FIGS. 1 and 2, at the beginning of tripping and at the end of tripping, and with FIG. 4 showing the views corresponding to FIGS. 1 and 2, and FIG. 3 showing a corresponding view from the rear face of the views illustrated in FIGS. 1 and 2.
Figure 4:
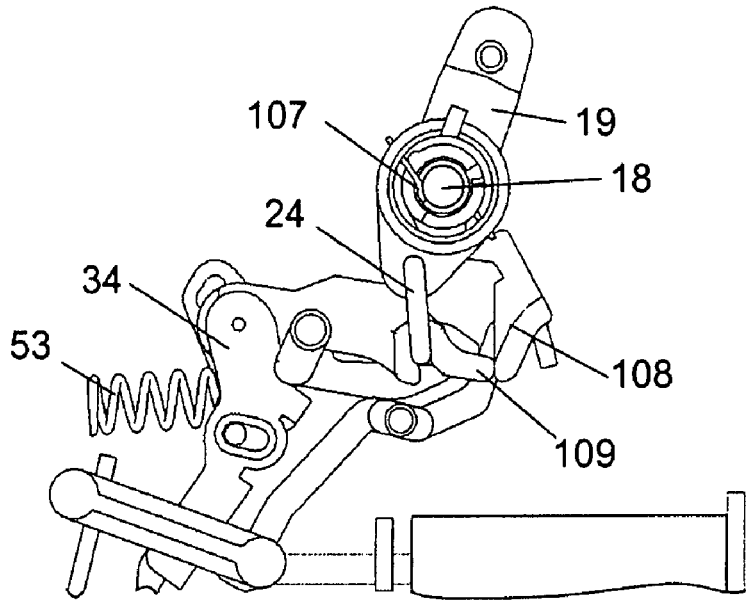

A miniature circuit breaker 10 which is partially shown in the area of its switching mechanism has an enclosure 11 which is composed of a shell-shaped lower housing part and a shell-shaped upper housing part. The view in FIGS. 1 and 2 shows only the enclosure lower part; in this case, FIGS. 3 and 4 show only the switching mechanism as such with a part of the contact lever, with the enclosure 11 being omitted. In addition, FIG. 3 shows the rear view of the switching mechanism, in order to illustrate this better.

The housing is a pedestal structure and has a front front wall 12, two rear front walls 13 and 14 which are not shown completely in the drawing, two front side walls 15 and 16 which connect the front front wall 12 to the rear front walls; and parallel with the front front wall and the rear front walls 13, 14, respectively, a mounting wall closing the housing at the bottom, is located which is not shown in FIGS. 1 to 4.

The front front wall 12 has an approximately semicircular bump or protrusion 17, in the area of which a switch handle 19 is supported on a bearing 18. The switch handle 19 is a two-armed lever with an operating handle 20 and an eye-shaped continuation 21 located in the interior of the switching device; in the eye-shaped continuation 21, a through opening 22 is located; the center point of the through opening 22, the center point of the bearing 18 and the center line of the operating handle 20 are located on one line or, respectively, aligned with one another.

The operating handle 20 protrudes from an opening 23 in the protrusion 17.

One limb (not illustrated) of a U-shaped clip 24 is inserted in the opening 22, with the web 25 of the clip being visible in FIGS. 1 to 4. The other limb of the U-shaped clip 24 engages in an aperture 26 in a lug 27 and in an elongated hole 28 in a latching lever 29, and is guided therein. The switching device also has a release lever 100, which is mounted such that it can rotate about the axis 18 of the operating handle 19. A recess 101 is located on this release lever 100 and, together with a latching tab 30 on the latching lever 29, forms the latching point. The latching tab 30 on the latching lever 29 is integrally formed at the end of the latching lever 29, which is located opposite the lug 27 (see FIG. 2), that is to say at the opposite end of a hinge shaft 33 between a contact lever 34 and the lug 27. Accordingly, the latching point is designated by the reference numbers 30/101 which includes the latching tab 30, recess 101 combination that is further explained in the text which follows. The other end of the lug 27 is connected by means of a hinge shaft 33 in an articulated manner with a contact lever 34 which exhibits approximately in its centre an elongated hole 35 by means of which it is supported rotatably in the housing 11 at a stationary pin 36. As a result, the contact lever 34 becomes a two-armed lever, the lever 37 located oppositely to the hinge shaft 33 carries the so-called moving contact member 38 which interacts with a stationary contact member 39. The latching lever 29 is rotatably supported in the housing (both in the lower housing part and in the upper housing part) at its end opposite the latching point 30, 101 via a pin arrangement 40.

The arrangement is designed in such a manner that the lug 27 and the latching lever 29 are approximately in line. In the on position, in which the latching tab 30 rests against the recess 101, the latch is in the on position, that is to say when the moving contact member 38 touches the stationary contact member 39 in a first stable position in which the centre axis of the web 25 passes laterally, on the left in the embodiment according to FIG. 2, next to the centre axis of the bearing or the rotary bearing 18 of the switch handle 19 so that the centre axis of the limb 25 forms an obtuse angle opened in the direction of the latching point 30/101 with the line formed by the centre axis of the opening 22 and the centre axis of the bearing 18. The lug 27 and the latching lever 29 are approximately parallel to the front front wall. In the on position, the clip 24 presses the lug away from the latching point 30/101 so that the resultant force produces the switching-on force. The elongated hole 35 lies with its end which is located on the side of the contact lever 34 on which the moving contact member is located. The elongated hole 35 extends approximately perpendicular to the longitudinal extent of the contact lever 34.

Underneath the rotation axis 18, that is to say between the rotation axis 18 and the electromagnetic release 46, on a line which runs approximately at right angles to the mounting plane through the axes 18 and 103. The striking lever 102 has a first arm 104 which extends into the area of the release lever 100 and interacts with a nose 105, see also FIG. 3. The striking lever 102 also has a second lever 106, which projects somewhat beyond the mounting plane, with its end covering the striking pin 48. The arm 104 projects beyond the front wall 12, and the arm 104 as well as the arm 106 together with one another form approximately a Z shape, with the end sections of the arms 104 and 106 running approximately parallel to one another.

At the free end of the arm 106, an end 49 of a connecting rod 50 is connected and hereby articulated, which engages behind a thermal bimetallic strip 52 which is the thermal release, by means of a pin 51 which protrudes perpendicular to the plane of the drawing into the latter and, therefore, is only shown dashed. The thermal release 52 is thus located between the pin 51 and the section 106.

The longitudinal axis of the connecting rod 50 extends approximately perpendicular to the longitudinal extent of the thermal bimetallic strip; in the embodiment according to FIGS. 1 to 4, the longitudinal extent of the thermal bimetallic strip 52 forms, together with the mounting side, an acute angle which is open towards the electromagnetic release.

Between the left-hand narrow side wall 15, that is to say the wall which is adjacent to the hinge 33, and the contact lever in the area between the hinge point 33 and the elongated hole 35, a compression spring 53 is provided which loads the contact lever clockwise around the bearing point 36 so that the compression spring 53 supports the off movement, that is to say the movement of the contact lever 34 out of the position according to FIG. 2 into the position according to FIG. 1.

If then the striker armature 48, due to a short circuit current, is moving in the direction of the arrow P, it presses on the arm 106 and, in dosing so, swivels the striker lever 102 clockwise around the axis of rotation 103 as a result of which the latching point 30/101 is unlatched, see FIG. 3, so that the latching lever 29 can swivel clockwise around its axis. In doing so, the limb of the clip 24 accommodated in the opening 26 of the lug 27 slides in the elongated hole 28 until it has reached the opposite, left-hand end of the elongated hole 28 shown in FIGS. 1 to 4. This releases the force of the spring 53; the end of the elongated hole 35 located opposite to the side of the contact lever, on which the moving contact member 38 is located, comes to rest against the stationary pin 36 so that the compression spring 53 can also swivel the contact lever 34 anticlockwise; as a result, the contact lever reaches its off position which has been reached at the end of tripping, see FIG. 4. The operating handle or switch handle 19 is released and can rotate anticlockwise around the axis 18 to the off position, which is reached by means of a spring arrangement 107 (see FIG. 4). During this process, the elongated holt releases the clip 24, so that the switching handle moves to the off position, as illustrated in FIG. 1, in which its nose 30 once again passes behind the recess 101 on the striking lever. The switch can now be reconnected by moving the operating handle 19 from its off position in the clockwise direction to the on position illustrated in FIG. 1.

If the thermal release 52 bends with a short-circuit current, the free end bends approximately in the direction of the arrow P and, in doing so, drives the section 100 of the striker lever via the rod or connecting rod 50 as a result of which the recess 101 moves away from the nose 30 and, as a result, the latching point is opened. The beginning of tripping is again shown in FIG. 3, the further sequence is the same as that described above.

Naturally, the latch described by means of a miniature circuit breaker can also be used in a residual current device; in this case, a release responding to a fault current would have to be used instead of the electromagnetic release 46 which responds to short-circuit current.

Naturally, the possibility also exists to use the latch for a motor circuit breaker in which, instead of a contact lever, a contact base is provided which carries a contact bridge which electrically conductively connects two stationary contact members, that is to say a pair of contact members, in the on state.

The release lever 100 has an incline 108 with which a projection 109 on the lug 27 makes contact during the release process, as can clearly be seen in FIG. 4. In consequence, the release lever, which may be coupled to a release lever in a miniature circuit breaker arranged adjacent to it, is pivoted further to its released position, so that the release lever in the adjacent miniature circuit breaker is moved reliably to its tripped position, so that the tripping process also takes place there as described above.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. An electrical switching device, comprising:

a thermal release;

an electromagnetic release;

a switching mechanism with a latching point and at least one contact point which is continuously opened or closed by means of the switching mechanism;

an operating handle which is connected to one end of a lug by a coupling element and another end of the lug of which is coupled to a contact base carrying the moving contact member; and a latching lever which, together with a release lever, forms the latching point, wherein the contact base for the moving contact member is located between the thermal release and the electromagnetic release, wherein the latching lever, together with a rotatably supported release lever interacting with the electromagnetic release and the thermal release forms the latching point, wherein the thermal release is coupled to the release lever by a connecting rod passing over the contact base, so that both the thermal release and the electromagnetic release open the latching point in an event of an overcurrent and/or short-circuit current and wherein a striking lever is provided, which is mounted such that it rotates or pivots by one of the thermal release or the electromagnetic release to unlatch the latching point, wherein the striking lever is a double-armed lever whose axis of rotation is arranged between the latching point and the electrical electromagnetic release, with the striking lever having a first arm interacting with the latching lever, and a second arm interacting with the thermal release and electromagnetic release, and wherein the second arm of the striking lever covers the electromagnetic release.

2. The switching device according to claim 1, wherein the axis of rotation of the striking lever is located in a final position on a line which is formed by bearing points of the release lever and of the operating handle, this line extending approximately perpendicular to a mounting plane or, respectively, to a front wall.

3. The switching device according to claim 1, wherein a spring arrangement is provided which permanently loads the striking lever in such a manner that it moves an impact armature to a ready-to-release position at an end of a tripping event to latch the latching point.

4. The switching device according to claim 1, in combination with a line, motor or fault-current circuit breaker.

* * * * *